US005131463A

United States Patent [19]

Zimmerli et al.

[11] Patent Number: 5,131,463

[45] Date of Patent: Jul. 21, 1992

[54] CORROSION PROTECTION FILTER FOR HEAT EXCHANGERS

[75] Inventors: Robert H. Zimmerli, Weedsport; Daniel P. Gaffaney, Chittenango, both of N.Y.

[73] Assignee: Carrier Corporation, Syracuse, N.Y.

[21] Appl. No.: 709,674

[22] Filed: Jun. 3, 1991

[51] Int. Cl.[5] ..... F28F 19/00

[52] U.S. Cl. ..... 165/119; 165/125; 165/134.1

[58] Field of Search ..... 165/119, 125, 134.1

[56] References Cited

U.S. PATENT DOCUMENTS

| | | | |
|---|---|---|---|
| 1,711,702 | 5/1929 | Spreen | 165/119 |
| 2,655,795 | 10/1953 | Dyer | 165/119 X |
| 2,769,620 | 11/1956 | Davison | 165/119 X |
| 2,808,237 | 10/1957 | Fosnes | 165/119 X |
| 4,018,270 | 4/1977 | Kolinger et al. | 165/119 |
| 4,287,067 | 9/1981 | Dyner | 210/487 |

FOREIGN PATENT DOCUMENTS

| | | | |
|---|---|---|---|
| 2306948 | 8/1974 | Fed. Rep. of Germany | 165/119 |
| 12501 | of 1895 | United Kingdom | 165/119 |

*Primary Examiner*—Allen J. Flanigan

[57] ABSTRACT

A filter system for protecting a heat exchange coil from corrosive constituents carried by an air stream which is passed through the heat exchange coil includes a flexible filter for removing the corrosive constituents from the air stream prior to its engaging with the coil. A net like spacer is located between the coil and the flexible filter for supporting the flexible filter in a predetermined spaced relationship with the heat exchange coil.

8 Claims, 2 Drawing Sheets

CORROSION PROTECTION FILTER FOR HEAT EXCHANGERS

BACKGROUND OF THE INVENTION

1. Field of the Invention

This invention relates in general to filters for heat exchangers. More specifically it relates to a filter for removing corrosive constituents from an air stream which is to be passed in heat exchange relation with a heat exchange coil.

2. Description of the Prior Art

Condensing units for many air conditioning systems are located outdoors where the heat transfer medium used for cooling the refrigerant flowing therethrough is ambient air. A typical outdoor coil assembly includes a vertically extending heat exchange coil and an axial fan having a driving motor mounted perpendicular to, and, at the top end of, the coil. During periods of fan operation, air is drawn in from the outside air to pass through the coil and exits from the unit upwardly through the fan. Typical coil construction comprises what is known as copper tube-aluminum fin coils. Such coils are subject to corrosion when in the presence of an electrolyte. This is due to the position of these materials on the electro-chemical table. Copper is an effective cathode and therefore causes a significant increase in anodic corrosion activity on the aluminum fins.

A large number of air conditioner condensing units are located in environments where an electrolytic solution commonly comes into contact with the copper-aluminum coils. Virtually any coastal, salt water location can experience this problem when mist laden with dissolved salt passes through the condensing coil. The resulting corrosion reduces thermal conduction and air flow causing a decrease in system performance and ultimately failure.

U.S. Pat. No. 1,711,702 "Condenser Assembly" discloses the use of a screen made of metallic wires for removing foreign particles from the flow of air impinging on a condenser heat exchange coil. Such a screen is capable of removing some of the corrosive constituents in an air stream, however a greatly enhanced removal efficiency is deemed desirable to increase the useful life of a condenser coil in a severe corrosive environment.

SUMMARY OF THE INVENTION

It is an object of the present invention to protect a heat exchange coil from corrosive constituents carried by an air stream which is passed through the coil.

It is another object of the present invention to pass the flow of air, to a heat exchange coil, which contains corrosive constituents through a filter means for effectively removing a high percentage of the corrosive constituents from the air stream prior to engaging the coil.

It is a further object of the present invention to provide a highly efficient, low cost, corrosion durable, electrolyte removal filter for a heat exchange coil.

It is yet another object of the present invention to provide a highly efficient, low cost, non-corrosive corrosion constituent removal filter for a condensing unit of an air conditioning system which is adapted to be installed within the confines of existing condensing units.

These and other objects of the present invention are achieved by apparatus for protecting a heat exchange coil from corrosive constituents carried by an air stream which is passed through the heat exchange coil. The apparatus includes a flexible filter means for removing the corrosive constituents from the air stream prior to its engagement with the coil. Further, net like means are located between the coil and the flexible filter means for supporting the flexible filter in a predetermined spaced relationship with the heat exchange coil.

BRIEF DESCRIPTION OF THE DRAWINGS

The novel features that are considered characteristic of the invention are set forth with particularity in the appended claims. The invention itself, however, both as to its organization and its method of operation, together with additional objects and advantages thereof, will best be understood from the following description of the preferred embodiment when read in connection with the accompanying drawings wherein like numbers have been employed in the different figures to denote the same parts, and wherein:

DESCRIPTION OF THE PREFERRED EMBODIMENT

Figure 1:
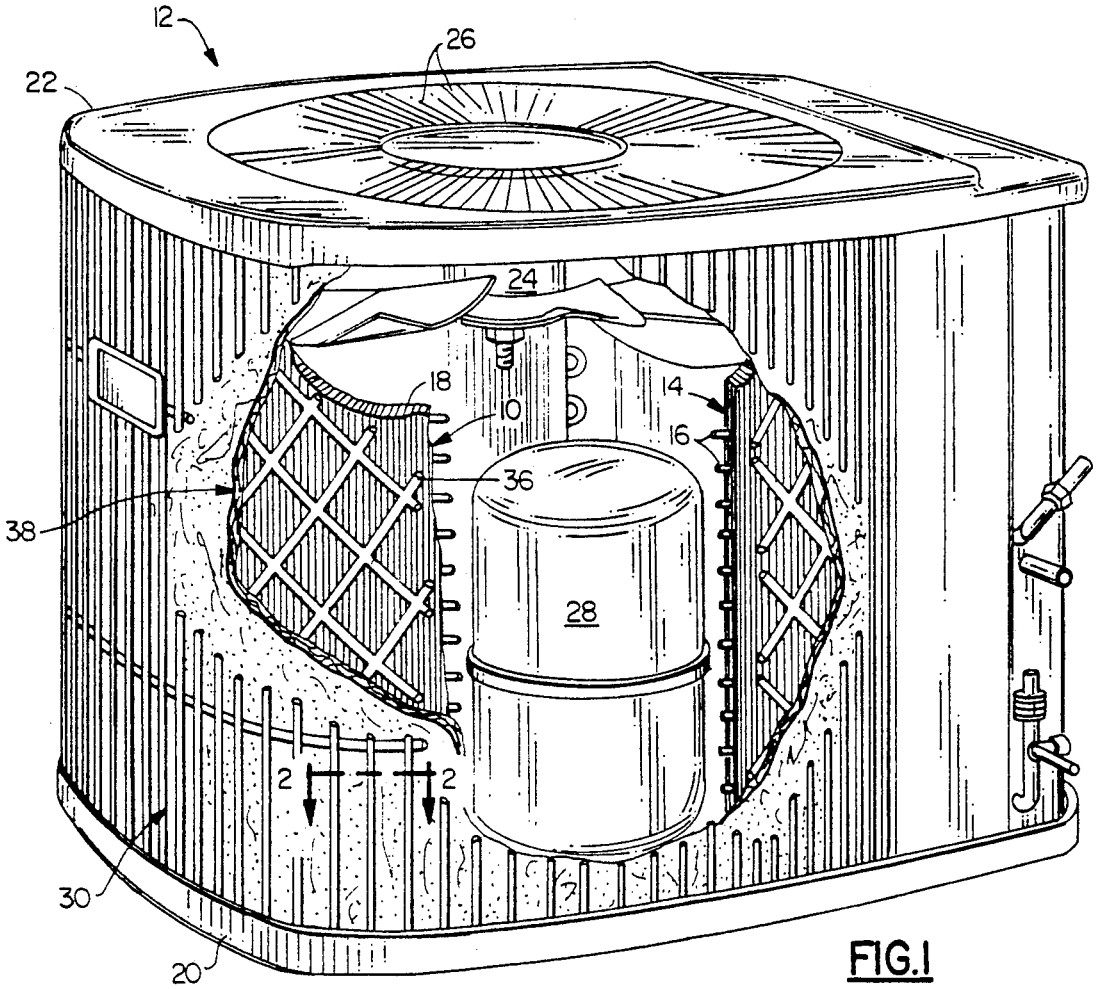
FIG. 1 is a perspective, partially broken away view of a condensing unit for a split system air conditioning system having a corrosion protection filter system according to the present invention.

Referring now to FIG. 1, the corrosion protection filter of the invention is shown generally at 10, incorporated into an outdoor coil assembly 12 of the type used in a conventional split system air conditioner. The outdoor coil assembly 12 includes a vertically extending heat exchanger coil 14 which includes a plurality of substantially horizontally extending copper tubes 16 and a large number of substantially parallel vertically extending aluminum fins through which the tubes 16 extend in heat exchange relation.

The outdoor coil assembly 12 further includes a base pan 20 and a top or cover 22. Mounted on the underside of the cover 22 is an axial fan/motor assembly 24. During periods of fan operation, air is drawn in from the outside air to pass through the heat exchange coil 14 and exits upwardly through a plurality of radially extending louvers 26 in the cover 22.

Figure 2:
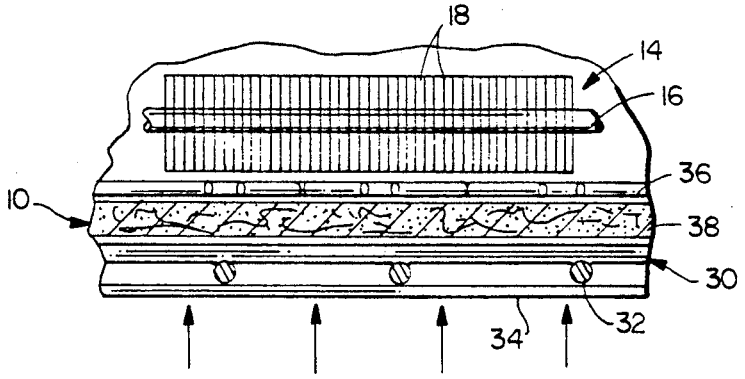
FIG. 2 is a sectional view taken along the line 2—2 of FIG. 1.

A compressor 28 as well as other necessary piping and controls etc. are contained within the outdoor coil assembly 12. A typical prior art outdoor coil assembly included an outer protective grille 30 extending between the base pan 20 and the cover 22. As shown in FIGS. 1 and 2 the grille 30 comprises a plurality of vertically extending rod like sections 30 and a number of circumferentially extending interconnecting sections 32. The primary purpose of this grille has been to prevent damage to the fragile fins of the heat exchange coil 14.

With continued reference now to both FIGS. 1 and 2 the corrosion protection filter 10 is made up of two components, which are sequentially installed on the heat exchange coil 14. First the entire outside surface of the coil 14 is wrapped with a net like material 36. In the preferred embodiment the net like material is a semi-rigid polyethylene plastic net material that has rectangular openings approximately $1\frac{3}{8}''$ by $1\frac{3}{4}''$. The openings are formed by a network of ligaments which are on the order of ⅛" thick.

Next, overlying, and completely covering, the net like material 36 is a layer of filter material 38 which is capable of removing corrosive constituents carried by an air stream which is passed through it. In the preferred embodiment the filter material is a ¼" thick ester type polyurethane foam having a porosity of 30 pores per inch. Both the net like element 36 and the filter 38 are held in place by the outer grille member 30.

Referring to FIG. 2, the net like material 36 and the filter 38 are illustrated as being spaced from one another and the net like material 36 as spaced from the face of the coil 14. This has been done to facilitate distinguishing one component from another in the drawing. This illustration may actually reflect the condition of the components when there is no air flow through the coil.

When the heat exchanger is in operation, however, and air is flowing in the direction indicated by the arrows in FIG. 2, the filter 38 will be in contact with the net like material 36 and the net like material 36 will be in contact with the face of the coil 14. At this time the net like material 36 supports the filter material 38, and, because of its geometric configuration serves to maintain the flexible filter material at a spaced relationship with the coil. This spacing, it will be seen, is vital to the highly efficient corrosive constituent removal efficiency of the filter system 10.

As thus installed all air flow which is caused to pass through the heat exchange coil 14 must first pass through the corrosion protection filter 10 made up of the filter 38 and the net like material 36. In circumstances where the air drawn through the corrosion protection filter is substantially dry, the pressure drop across the filter 10 is very low, compared to the overall pressure drop of the system, and accordingly does not adversely effect the performance of the heat exchange coil.

When the air flow to the heat exchange coil contains a high level of water therein, the pressure drop across the corrosion protection filter 10, is likewise low compared to the system overall pressure drop. At the same time a very high percentage of the water is removed from the air by the corrosion protection filter 10 prior to reaching the heat exchange coil 14.

As pointed out above a typical application of the corrosion protection filter 10 is in an air conditioner condensing unit used in a region adjacent to a body of salt water. In such an application the cooling air drawn across the coils is quite often a mist which comprises an aggregate of microscopic water droplets suspended in the atmosphere. These droplets have salt dissolved therein forming an electrolyte which, as mentioned above, will promote undesirable corrosion if it finds its way to the copper aluminum coil 14.

As the moisture laden air passes through the polyurethane filter 38 it is believed that the filter provides condensing surfaces upon which small particles of the electrolyte will adhere. Eventually the small particles will combine or coalesce to form drops of electrolyte which eventually are of sufficient size to fall, under the influence of gravity towards the base 20.

Again, as pointed out above, the spacing of the electrolyte removing filter 38 from the inlet surface of the coil 14 by the net like material 36 is extremely important to the efficacy of the filter system 10. It is clear that the fact that the filter material 36 does not contact the coil 14 prevents electrolyte, which has been removed from air flow, from "wicking" to the coil 14.

Figure 3:
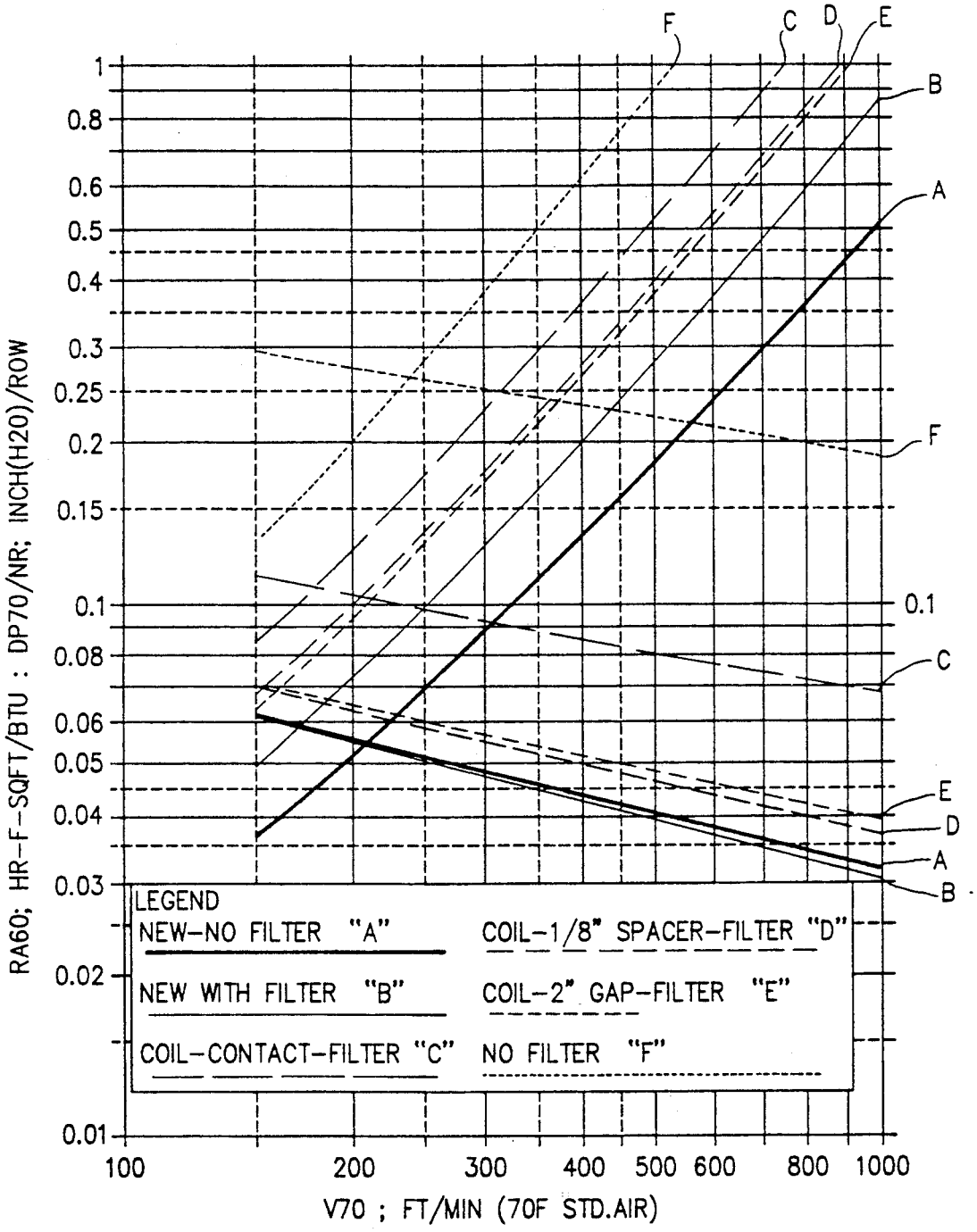
FIG. 3 is a graphical representation which illustrates the beneficial results of the corrosion protection filter system of the present invention over a period of time.

The dramatic increase in corrosion durability of a heat exchange coil 14 protected by a corrosion protection filter 10 according to the present invention is illustrated by the data presented in graphical form in FIG. 3. This Figure presents data obtained from analysis of four identical heat exchange coils subjected to the same severe marine environment over a period of six months. All of the coils were three row 1 inch by 0.866 inch copper tube-aluminum fin construction. All were running at 600 feet per minute air velocity with the fans running in the draw through mode for a period of 16 hours per day.

The first coil tested had no corrosion protection filter 10 associated with it. This coil is represented, at the beginning of the test, by the curves "A". The data for this same unprotected filter, following six months exposure at the test conditions, is represented by the curves "F".

The remaining three heat exchange coils were all protected, to varying degrees, by a filter comprising a layer of thirty pore per inch, ¼" thick, ester type polyurethane foam. The difference between these coils relates to the proximity of the layer of polyurethane foam with respect to the coil surface. It will be noted that in the graph of FIG. 3 a single set of data for a heat exchange coil is represented by the curves "B" which are identified in the Legend as "New With Filter". This data represents any one of the three filtered coils at the onset of the six month test and reflects the fact that the positioning of the polyurethane filter with respect to the coil had no initial effect upon the heat transfer characteristics of the coil. As will be discussed below the presence of the filter did have an initial pressure-drop effect.

The condition of the first filtered coil at the end of the six month test is represented in FIG. 3 by the curves "C" which are identified as Coil-Contact-Filter in the Legend. In this coil the layer of polyurethane foam was mounted in direct contact with the face of the fins of the heat exchange coil.

The condition of the second filtered coil at the end of the six month test is represented in FIG. 3 by the curves "D" which are identified in the Legend as "Coil-⅛" Spacer-Filter". This represents the construction of the preferred embodiment as described above.

Finally, the condition of the third filtered coil at the end of the six month test is represented by the curves "E" which are identified in the Legend as "Coil-2" Gap-Filter". This coil had the polyurethane foam filter supported 2 inches away from the face of the heat exchange coil.

Looking now at the FIG. 3 graph the horizontal axis represents the velocity of air, in feet per minute, flowing through the heat exchanger coils at given standard test conditions. The vertical axis plots data for two different parameters. The first is overall air-side thermal resistance at given, standard conditions. This data is represented by the set of curves which run generally from the upper left hand corner to the lower right hand corner of the graph. The second parameter identified on the vertical axis is pressure drop across the coil, again at accepted standard conditions. This data is represented by the set of curves which run from the lower left hand corner to the upper right hand corner.

Looking first at the pressure drop curves it is evident that for any given velocity, at the beginning of the test the new coil with no filter, i.e. curve "A", had a lower pressure drop than the new filtered coils, i.e. curve "B". Following the six month test in the severe marine environment the pressure drop across the unfiltered coil had dramatically increased, as evidenced by curve "F".

Equally dramatic is the relatively modest increase in pressure drop across the two coils having corrosion protection filters spaced from the coil, i.e. curves "D" & "E". The coil having the filter spaced by the thin net-like material, curve "E", clearly was best protected from the corrosive environment. The coil having the filter in contact with the coil face, curve "C" showed pressure drops substantially greater than the spaced filter embodiments.

Looking now at the thermal resistance curves, the results are comparable to those discussed above. Comparison of curves "A" & "B" shows a lower thermal resistance for the filtered coils ("B") at the beginning of the test. After six months the thermal resistance of the unfiltered coil, i.e. curve "F" had increased by a factor of five. The coil contact filter, i.e. curve "C" had increased by a factor of two. The coils having corrosion protection filters spaced from the coil, i.e. curves "D" & "E" both showed only a slight increase in thermal resistance, with the two inch spaced coil showing slightly better results.

In order to evaluate both the effect of changes in thermal resistance and air-flow resistance through a coil, a term which may be referred to as the corrosion durability factor was developed. This term is defined as follows:

$$\text{Corrosion Durability Factor } (CDF) = \frac{1}{\sqrt{\frac{Ra}{Ranew} \cdot \frac{DPA}{DPnew}}}$$

Where:

Ra = Airside Thermal Resistance at a measured point in time

Ranew = Airside Thermal Resistance of a new coil

DPa = Pressure Drop at a measured point in time

DPnew = Pressure Drop across a new coil

Applying this relationship to the coils discussed above, comparing the new coils to data at the end of the six-month test yields the following results:

| | CDF After Six Month Test |
|---|---|
| Unprotected Coil | .2 |
| Coil w/filter in contact | .51 |
| Coil w/⅛" spacer for filter | .80 |
| Coil/2" space for filter | .78 |

It is evident from the above data, looking at the overall effect of changes in thermal resistance and air flow resistance, that the coil having the ⅛" spacer for the filter provided overall superior results in the test conducted. This result is significant in that it allows a corrosion protection filter system for a condensing unit of an air conditioning system to be easily installed within the confines of existing condensing units.

It should be appreciated that the particular material selected for the filter is exemplary and that corrosion removal filters made from other materials and having other thickness and densities may be used for other heat exchanger applications. The particular filter selected for the preferred embodiment disclosed herein was found to provide excellent corrosion constituent removal capability while providing an initial pressure drop penalty which was acceptable.

The invention has been described, by way of example, in connection with an air conditioning condensing coil having an aluminum-copper coil, through which air containing a coastal mist is drawn through by a fan. It should be understood that any heat exchange coil, whether it be all aluminum, all copper, or some other construction is subject to corrosion when a cooling medium containing an electrolyte passes therethrough. The electrolyte could, for example, be dissolved road salt from a wet highway, and the heat exchange coil, an automobile radiator or the like. Further, the air flow through the coil could be caused by means other than a draw through fan, such as a fan blowing air directly through the coil, or, possibly by a ram-air effect.

Accordingly, it should be appreciated that a filter system for protecting a heat exchange coil from corrosive constituents carried by an air stream which is passed through the heat exchange coil has been provided. The apparatus includes a flexible filter means for removing the corrosive constituents from the air stream prior to its engagement with the coil. Further, net like means are located between the coil and the flexible filter means for supporting the flexible filter in a predetermined spaced relationship with the heat exchange coil.

This invention may be practiced or embodied in still other ways without departing from the spirit or essential character thereof. The preferred embodiment described herein is therefore illustrative and not restrictive, the scope of the invention being indicated by the appended claims and all variations which come within the meaning of the claims are intended to be embraced therein.

What is claimed is:

1. Apparatus for protecting a heat exchanger from corrosive constituents carried by an air stream, which is passed therethrough, comprising;

a heat exchange coil;

a net-like spacer in overlying contact with said coil; and flexible filter means for removing the corrosive constituents from the air, in overlying contact with said net-like spacer, whereby said spacer maintains said flexible filter means in a predetermined spaced relationship with said coil.

2. The apparatus of claim 1 wherein the heat exchange coil is of the type having a plurality of closely spaced fins defining a substantially planar surface, and, wherein said net like means is in contact with the planar surface.

3. The apparatus of claim 1 wherein said flexible filter means is made from a polyeurethane foam.

4. The apparatus of claim 4 wherein said filter is made from an ester type polyeuerthane foam having a porosity of from 20 to 40 pores per inch.

5. The apparatus of claim 1 wherein said net like means is made from a non-corrosive material.

6. The apparatus of claim 5 wherein said net like means is made from a semi-rigid polyethylene plastic net material.

7. The apparatus of claim 6 wherein said net like material is formed by a network of ligaments which are on the order of 150" thick.

8. An improved heat exchange apparatus of the type having a vertically extending coil assembly and a fan for drawing air radially inwardly through an inlet face of the coil, wherein the improvement comprises:

a filter system for protecting the coil from corrosive constituents carried by a flow of cooling air comprising;

a net like spacer positioned in confronting, co-extensive contact with said inlet face of said coil; and a flexible filter means for removing the corrosive constituents from the air positioned in overlaying co-extensive relationship with said net like spacer, whereby, said spacer maintains said flexible filter means spaced from the inlet face of said coil.

* * * * *